United States Patent [19]

Westmoland

[11] Patent Number: 4,802,070

[45] Date of Patent: Jan. 31, 1989

[54] ELECTRICAL CIRCUIT JEWELRY

[76] Inventor: Randy C. Westmoland, P.O. Box 92, Skiatook, Okla. 74070

[21] Appl. No.: 161,717

[22] Filed: Feb. 29, 1988

Related U.S. Application Data

[63] Continuation-in-part of Ser. No. 899,172, Aug. 22, 1986, and Ser. No. 899,171, Aug. 22, 1986.

[51] Int. Cl.[4] ..... F21L 15/08

[52] U.S. Cl. ..... 362/104; 362/252; 362/800; 362/806; 63/1.1

[58] Field of Search ..... 362/103, 104, 252, 800, 362/806; 63/1.1, 12

[56] References Cited

U.S. PATENT DOCUMENTS

| | | | |
|---|---|---|---|
| 3,508,041 | 4/1970 | Sweany et al. | 240/6.4 |
| 3,814,926 | 6/1974 | Frasca | 240/6.4 |
| 3,866,035 | 2/1975 | Richey, Jr. | 240/6.4 |
| 3,968,357 | 7/1976 | Hamilton | 240/6.4 |
| 4,237,525 | 12/1980 | Deter | 362/104 |
| 4,309,743 | 1/1982 | Martin | 362/104 |
| 4,337,504 | 6/1982 | Simpson | 362/104 |
| 4,408,261 | 10/1983 | Polakoff | 362/104 |
| 4,459,645 | 7/1984 | Glatter | 362/104 |

*Primary Examiner*—Stephen F. Husar

[57] ABSTRACT

An article of jewelry includes at least one electrically activated light source, at least two elongated and stiff electrical conductors connected to and extending from the light source, and an attachment assembly for attaching the article of jewelry to a wearer. The electrical conductors conduct electrical power to the light source and are spaced apart to provide an aperture for detachably receiving and retaining an electrical power source between the conductors with at least one conductor contacting the positive terminal and at least one conductor contacting the negative terminal of the electrical power source. The conductors frictionally retain the power source in the aperture. The conductors, aperture, light source, and electrical power source are the visible article of jewelry when the article of jewelry is being worn. The article of jewelry may be worn with or without the electrical power source.

22 Claims, 2 Drawing Sheets

ELECTRICAL CIRCUIT JEWELRY

CROSS REFERENCE TO RELATED APPLICATIONS

This application is a continuation-in-part of application Ser. No. 899,172 filed Aug. 22, 1986, pending, and application Ser. No. 899,171, also filed Aug. 22, 1986, pending.

BACKGROUND OF THE INVENTION

This invention relates to illuminated jewelry and more particularly to illuminated jewelry in which the jewelry itself is the electrical lighting circuit.

Illuminated jewelry has been known in the art for sometime. The disclosure statement filed with this document discloses a number of various types of illuminated jewelry.

A shortcoming in the illuminated jewelry known in the art is the absence of an article of jewelry in which the entire ornamental structure of the article of jewelry is the light source and the electrical conductors necessary to carry electrical power to the light source. Another shortcoming is the absence of an article of jewelry in which the electrical power source, if installed, becomes a part of the visible ornamental structure of the article of jewelry. Another shortcoming is the absence of an article of jewelry which will easily accommodate power sources of various shapes, thereby allowing the power source to be shaped to accent the aesthetic appearance of the jewelry.

SUMMARY OF THE INVENTION

Accordingly, it is an object of this invention to provide an article of jewelry in which the entire ornamental structure of the jewelry is a light source and the electrical conductors necessary to carry electrical power to the light source.

It is a further object of this invention to provide an article of jewelry in which the electrical power source, when installed, becomes a part of the visible ornamental structure of the jewelry.

It is an advantage of this invention to provide an article of illuminated jewelry which is inexpensive to manufacture.

It is a further advantage of this invention to provide an article of illuminated jewelry in which the electrical circuit may be electrically isolated from the body or clothing of the wearer.

It is a further advantage of the present invention to provide an article of jewelry which may be easily configured for use as virtually any type of jewelry and with virtually any type of fastener. For example, an ear clasp may be connected to the article of jewelry allowing the jewelry to be worn as an earring for pierced or non-pierced ears. The invention may also be configured for use on a clothing pin, a hair pin, a belt buckle, a watch strap, etc.

The article of jewelry of the present invention includes at least one electrically activated light source, at least two elongated and stiff electrical conductors extending from the light source, and attachment means for attaching the article of jewelry to a wearer. The conductors are spaced apart to provide an aperture for detachably receiving and retaining an electrical power source, such as an electrical battery. The light source may be a light emitting diode or an incandescent light bulb. The article of jewelry may be worn with or without the power source installed. If the power source is installed it becomes part of the visible ornamental structure of the jewelry.

BRIEF DESCRIPTION OF THE DRAWINGS

The present invention will be better understood by reference to the examples of the following drawings.

DETAILED DESCRIPTION OF THE PREFERRED EMBODIMENTS

Before explaining the present invention in detail, it is to be understood that the invention is not limited to the details of construction and arrangement of parts illustrated in the accompanying drawings, since the invention is capable of other embodiments and of being practiced and carried out in various ways commensurate with the claims herein. Also, it is to be understood that the terminology employed herein is for the purpose of description and not of limitation.

FIGS. 1 through 10 present a preferred embodiment of an article of illuminated jewelry, generally designated 20, which exemplifies the present invention. The illustrated embodiment is an illuminated earring 20. It is intended to be obvious from the following description and claims that the invention may be equivalently applied to other types of jewelry and ornamentation, such as brooches, hair pins, belts and belt buckles, watch bands, etc.

Figures 1, 2, 3, 4, 5, 6:
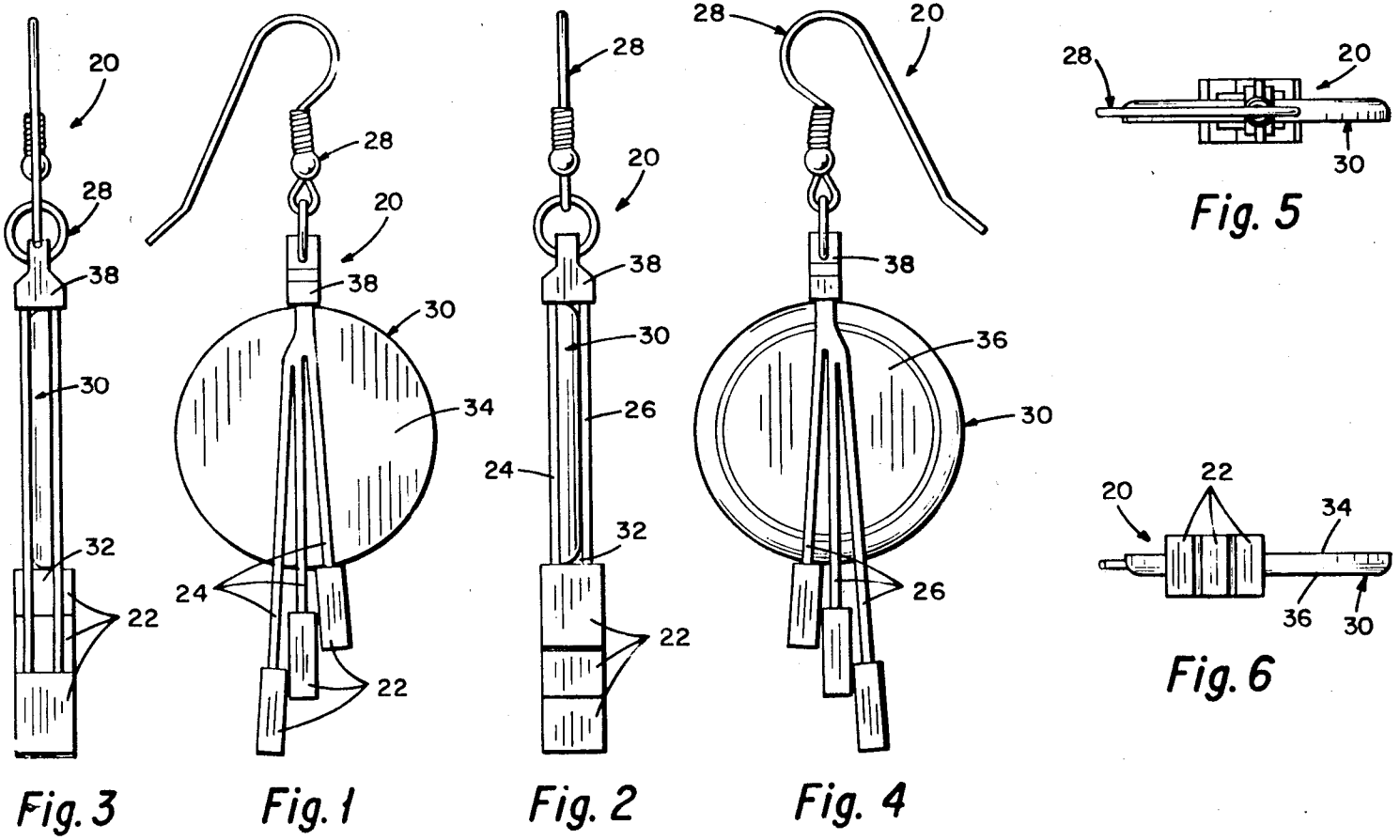
FIG. 1 is a front view of a preferred embodiment of the electric circuit jewelry of the present invention.
FIG. 2 is a right side view of FIG. 1.
FIG. 3 is a left side view of FIG. 1.
FIG. 4 is a rear view of FIG. 1.
FIG. 5 is a top view of FIG. 1.
FIG. 6 is a bottom view of FIG. 1.

Referring to the example of FIGS. 1 and 2, the invention may be described as being generally comprised of at least one electrically activated light source 22, at least two elongated and stiff electrical conductors 24, 26 connected to and extending from the light source 22 for conducting electrical power to the light source, and attachment means 28 for attaching the article of jewelry 20 to a wearer.

Figure 7:
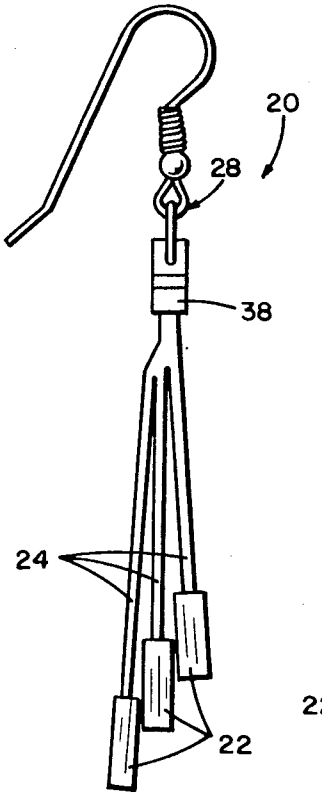
FIG. 7 illustrates the electric circuit jewelry of FIG. 1 with the electrical power source removed.

An electrical power source 30 is needed to provide electrical power to illuminate the light source 22, although as illustrated by FIG. 7 the jewelry 20 may also be worn without the power source 30, as further discussed below.

The light source 22 should be of a type in which the only visible structure is the light source or lamp 22. By light source is meant the element (not illustrated) which converts the electrical energy into light energy, the translucent or opaque cover which is used to disperse the light energy, and the support structure (if any) necessary to physically support the element and cover. In this description the electrical conductors 24, 26 are treated as being independent from the light source 22 although in actuality the conductors may be an integral part of the light source. The light source 22 may take other forms requiring more extensive support circuitry and physical structure, although, as previously stated, it is preferred that the light source 22 be limited to minimum componentry in order to preserve the simplicity and economy of the present invention. In the preferred embodiment the light source 22 is a light emitting diode, although an incandescent light bulb or equivalent may be used.

Figure 8:
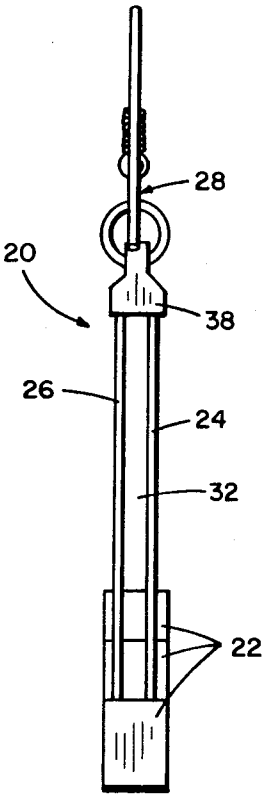
FIG. 8 is a left side view of FIG. 7.

Referring to the example of FIGS. 2 and 8, in the preferred embodiment the conductors 24, 26 are spaced apart to provide an aperture 32 for detachably receiving and retaining an electrical power source 30. At least one conductor 24 or 26 should contact the positive terminal 34 of the electrical power source 30 and at least one conductor 24 or 26 should contact the negative terminal 36 of the electrical power source 30, best seen in FIGS. 1 and 4. The conductors 24 or 26 which contact the positive terminal 34 of the power source 30 should be electrically isolated from the electrical conductors 24 or 26 which contact the negative terminal 36 of the power source to prevent short circuiting the power source 30. In the preferred embodiment, the conductors 24, 26 frictionally retain the power source 30 in the aperture 32. The light source 22 may also provide one side of the aperture, thus providing a three sided aperture for detachably receiving and retaining the power source 30. In one embodiment, best seen in FIG. 2, an isolator 38 is provided to electrically isolate the power source 30 and conductors 24, 26 from the attachment means 28 and the isolator 38 is used to provide a fourth side of aperture 32. The isolator may also be a light source which receives electrical power through conductors 24, 26 and which isolates the attachment means 28 from the conductors 24, 26 and power source 30.

As previously mentioned, the aperture 32 should be arranged to detachably receive and retain an electrical power source 30 having an electrically positive terminal 34 and electrically negative terminal 36. In the preferred embodiment the power source 30 is a visible ornamental addition to the article of jewelry 20 when the power source is retained in the aperture 32. Preferably the power source 30 is an electrical battery, and in the preferred embodiment a lithium type battery is used. As intended to be obvious from this description and the drawings, it is not necessary that the power source 30 be installed in aperture 32 for the jewelry 20 to be worn, as best illustrated by FIGS. 1 and 7. The jewelry is equally as attractive with or without electrical power source 30 and the jewelry 20 may appear to be to entirely different items of jewelry when worn with and without the power source 30 installed. The electrical power source 30 may be made in virtually any shape, e.g., triangular, oblong, tear-shaped, etc. in order to accent the appearance of the jewelry and the conductors 24, 26 may be assembled, manufactured, or bent into any shape or configuration which may be felt to be aesthetically attractive and which will complete the electrical lighting circuit, i.e., with one conductor of each light source contacting the negative terminal 36 of the power source 30 and the other conductor of the light source contacting the positive terminal 34 of the power source.

When light emitting diodes are used as light source 22 it is essential that the designated positive conductors 24 or 26 be grouped on one side of aperture 32 and the designated negative leads 24 or 26 be grouped to form the other side of aperture 33, since light emitting diodes will only illuminate when positive biased, that is, when their designated positive leads or conductors are in contact with the positive terminal of an electrical power source 30 and their designated negative leads or conductors 24 or 26 are in contact with the negative terminal of the electrical power source 30.

One advantage of using light emitting diodes for the light source 22 is that the power source 30 may be installed and worn without illuminating the diodes by installing the power source in such a manner that the diodes are reversed biased, that is, by installing the power source 30 where the positive terminal 34 of the power source contacts the designated negative conductors 24, 26 and the negative terminal of the battery contacts the designated positive conductors 24, 26. This feature is particularly advantageous when the power source 30 contributes significantly to the aesthetic appeal of the article of jewelry 20.

Figure 10:
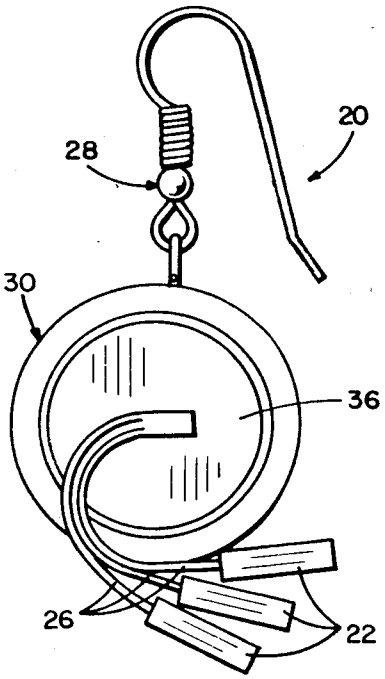
FIG. 10 is a rear view of FIG. 9.
Figure 9:
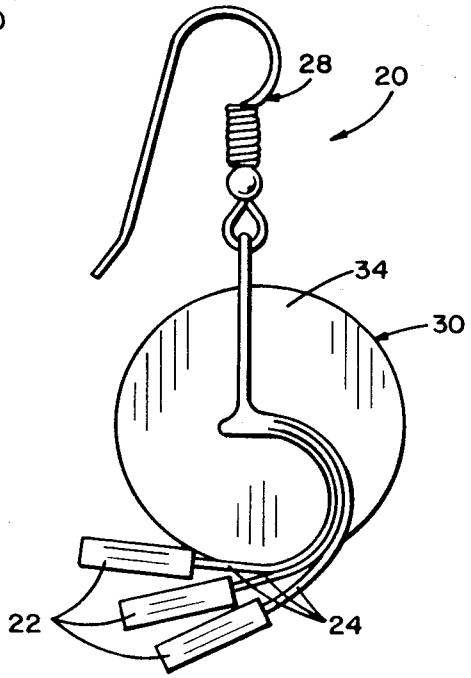
FIG. 9 is a front view of another embodiment of the electrical circuit jewelry of the present invention.

In the illustrated preferred embodiment three light emitting diodes are configured into a triangular shape, best seen in FIGS. 1 and 4 and into an arcuate shape best seen in FIGS. 9 and 10, although any style, shape, or model of light source may equivalently be used. In the illustrated, preferred embodiment, the positive terminal contacting conductors 24 or 26 are arranged to form a pattern on the positive terminal 34 side of the power source receiving aperture 32 the same as the pattern formed by the negative terminal contacting conductors 24 or 26 on the negative terminal 36 side of the power source receiving aperture 32. The conductors 24, 26 should be arranged to securely retain the electrical power source 30 and to make good electrical contact with the positive and negative terminals 34, 36 of the power source 30, and within these general guidelines the conductors may take any configuration which is aesthetically or functionally pleasing.

Referring to FIGS. 1 and 9, in the preferred embodiment the attachment means 28 is located near the opposite end of the conductors 24, 26 from the light source 22. The attachment means 28 is placed in this location so that the jewelry 20 will depend from the attachment means 28 in order to make an attractive earring. the attachment means may be located any place on the article of jewelry 20 which will not electrically short circuit the power source 30 and conductors 24, 26. For example, if the jewelry 20 is to be used as a brooche or hair pin, it may be more aesthetically pleasing to hide the attachment means 28 behind the power source 30.

In the preferred embodiment the attachment means 28 is electrically isolated from the power source 30 in order to electrically isolate the jewelry 20 from the body of the wearer. Since the preferred embodiment is an earring, and the attachment means 28 is an ear clasp for attaching the jewelry or earring 20 to a human ear, it is preferable to electrically isolate the electrical circuit from the ear. Even though it is unlikely that the wearer would feel any electrical discharge, this electrical isolation should prolong the life of the battery by preventing discharge of the battery through the ear and the wearer's body. Similarly, it is recommended that, regardless of the type of application of the invention, the jewelry be isolated from the body or clothing of the wearer in order to maximize the life of the battery and the length of time which the battery will illuminate the light source 22.

The preferred embodiments were constructed by taking three light emitting diodes, cutting the conductors 24, 26 to the desired length, soldering the conductors 24 together, soldering the conductors 26 together, and connecting attachment means 28 to the opposite end of the conductors 24, 26 from the light source 22. In the embodiment of FIG. 1 the attachemnt means 28 is connected to isolator 38 which is in turn connected to the solderingly united conductors 24, 26 in such a manner to effectively electrically isolate conductors 24 from conductors 26 and isolate attachment means 28 from conductors 24, 26. In the embodiment of FIGS. 1–8, the isolator 38 is also a light emitting diode. In the embodiment of FIG. 9, the conductors 24, 26 are bent after soldering to give the earring 20 its arcuate shape and the attachment means 28 is soldered to one of the soldering connected groups of conductors 24 and 26 thus maintaining the electrical isolation of conductors 24 from conductors 26 and maintaining the electrical isolation of the attachment means 28 from the conductors 24, 26 and power source 30.

It is intended to be obvious from this description that any number of light sources 22 and conductors 24, 26 may be used and may be bent, manufactured, and assembled into any desired shape, as long as the conductors 24, 26 are arranged to securely retain the electrical power source 30 and to make good electrical contact with the positive and negative terminals 34, 36 of the power source 30.

While the invention has been described with a certain degree of particularity, it is manifest that many changes may be made in the details of construction and the arrangement of components without departing from the spirit and scope of this disclosure. It is to be understood that the invention is not limited to the embodiments set forth herein for purposes of exemplification, but is to be limited only by the scope of the attached claim or claims including the full range of equivalency to which each element thereof is entitled.

What is claimed is:

1. An article of jewelry, comprising:

at least one electrically activated light source;

at least two elongated and stiff electrical conductors connected to and extending from the light source for conducting electrical power to the light source, the conductors being spaced apart to provide an aperture for detachably receiving and retaining an electrical power source having an electrically positive terminal and an electrically negative terminal, at least one conductor contacting the positive terminal and at least one conductor contacting the negative terminal of the power source, the positive terminal contacting conductors being electrically isolated from the negative terminal contacting conductors, the conductors, aperture, and light source being the visible article of jewelry when the article of jewelry is being worn; and attachment means for attaching the article of jewelry to a wearer.

2. The article of claim 1:

wherein the conductors frictionally retain the power source in the aperture.

3. The article of claim 1:

wherein the light source is one side of the aperture for detachably receiving and retaining the electrical power source.

4. The article of claim 1 further comprising:

an electrical power source having an electrically positive terminal and an electrically negative terminal, the power source being a visible ornamental addition to the article of jewelry when the power source is retained in the aperture.

5. The article of claim 4:

wherein the power source is an electrical battery.

6. The article of claim 1:

wherein the light source is a light emitting diode.

7. The article of claim 1:

wherein the light source is an incandescent light bulb.

8. The article of claim 1:

wherein the positive terminal contacting conductors form a pattern on the positive terminal side of the power source receiving aperture the same as the pattern formed by the negative terminal contacting conductors on the negative terminal side of the power source receiving aperture.

9. The article of claim 1:

wherein the attachment means is an ear clasp for attaching the article of jewelry to a human ear.

10. The article of claim 1:

wherein the attachment means is located near the opposite end of the conductors from the light source.

11. The article of claim 1:

wherein the attachment means is electrically isolated from the power source.

12. An article of jewelry, consisting essentially of:

at least one electrically activated light source;

at least two elongated and stiff electrical conductors connected to and extending from the light source for conducting electrical power to the light source, the conductors being spaced apart to provide an aperture for detachably receiving and retaining an electrical power source having an electrically positive terminal and an electrically negative terminal, at least one conductor contacting the positive terminal and at least one conductor contacting the negative terminal of the power source, the positive terminal contacting conductors being electrically isolated form the negative terminal contacting conductors, the conductors, aperture, and light source being the visible article of jewelry when the article of jewelry is being worn; and attachment means for attaching the article of jewelry to a wearer.

13. The article of claim 12:

wherein the conductors frictionally retain the power source in the aperture.

14. The article of claim 12:

wherein the light source is one side of the aperture for detachably receiving and retaining the electrical power source.

15. The article of claim 12 further consisting essentially of:

an electrical power source having an electrically positive terminal and an electrically negative terminal, the power source being a visible ornamental addition to the article of jewelry when the power source is retained in the aperture.

16. The article of claim 15:

wherein the power source is an electrical battery.

17. The article of claim 12:

wherein the light source is a light emitting diode.

18. The article of claim 12:

wherein the light source is an incandescent light bulb.

19. The article of claim 12:

wherein the positive terminal contacting conductors form a pattern on the positive terminal side of the power source receiving aperture the same as the pattern formed by the negative terminal contacting conductors on the negative terminal side of the power source receiving aperture.

20. The article of claim 12:

wherein the attachment means is an ear clasp for attaching the article of jewelry to a human ear.

21. The article of claim 12:

wherein the attachment means is located near the opposite end of the conductors from the light source.

22. The article of claim 12:

wherein the attachment means is electrically isolated from the power source.

* * * * *